US006693562B2

(12) United States Patent
Rostren

(10) Patent No.: US 6,693,562 B2
(45) Date of Patent: Feb. 17, 2004

(54) SYSTEM AND A METHOD FOR LOCATING A RAIL VEHICLE AT POINTS ALONG A RAIL TRACK EQUIPPED WITH BEACONS AND AN ANTENNA ADAPTED TO BE FITTED TO THE SYSTEM

(75) Inventor: Jacques Rostren, Margny les Compiegne (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/025,554

(22) Filed: Dec. 26, 2001

(65) Prior Publication Data

US 2002/0121991 A1 Sep. 5, 2002

(30) Foreign Application Priority Data

Jan. 22, 2001 (FR) ..... 01 00812

(51) Int. Cl.[7] ..... G08G 1/123

(52) U.S. Cl. ..... 340/988; 340/933; 340/941; 246/122 R

(58) Field of Search ..... 340/988, 933, 340/905, 941, 686.2; 246/122 R, 167 R, 187 B; 180/167, 169; 701/19

(56) References Cited

U.S. PATENT DOCUMENTS 3,771,119 A * 11/1973 Evans ..... 340/23
3,786,411 A * 1/1974 Kurauchi et al. ..... 340/988
3,877,666 A * 4/1975 Itakura et al. ..... 246/122 R
4,679,046 A * 7/1987 Curtis et al. ..... 342/51
4,863,123 A * 9/1989 Bernard et al. ..... 246/122 R
5,592,158 A * 1/1997 Riffaud ..... 340/941
6,501,381 B1 * 12/2002 Pilested ..... 340/572.2

FOREIGN PATENT DOCUMENTS

FR 2 713 574 A 6/1995

OTHER PUBLICATIONS

Patent Abstracts of Japan, vol. 004, No. 149 (P–032), Oct. 21, 1980, & JP 55 098306A (Kokusai Electric Co. Ltd), Jul. 26, 1980 *abstract*.

* cited by examiner

*Primary Examiner*—Benjamin C. Lee
*Assistant Examiner*—Phung Nguyen
(74) *Attorney, Agent, or Firm*—Sughrue Mion, PLLC

(57) ABSTRACT

A system locates a rail vehicle at points along a rail track equipped with a system of beacons which convey information to the vehicle by transmitting an electromagnetic signal. The vehicle includes an antenna having a first receiver circuit for picking up electromagnetic signals transmitted by the beacon when the antenna passes it. The antenna includes a second receiver circuit in the form of a figure-of-eight loop for accurately determining the moment at which the antenna is centered over the beacon.

13 Claims, 2 Drawing Sheets

SYSTEM AND A METHOD FOR LOCATING A RAIL VEHICLE AT POINTS ALONG A RAIL TRACK EQUIPPED WITH BEACONS AND AN ANTENNA ADAPTED TO BE FITTED TO THE SYSTEM

BACKGROUND OF THE INVENTION

1. Field of the Invention

The invention relates to a system and a method for locating a rail vehicle at points along a rail track equipped with a system of beacons. It relates more particularly to a system for accurately locating a rail vehicle relative to a beacon transmitting an electromagnetic signal conveying information. The invention also relates to an antenna adapted to be fitted to a rail vehicle in the system.

2. Description of the Prior Art

Equipping rail transport networks with a system of beacons on the ground for transmitting information between the beacons and equipment on board the vehicle is known in the art. The document FR-A-2 713 754 discloses a system of beacons on the ground, powered by radiation and enabling communication with an antenna on board a rail vehicle. Using a system of beacons for locating the rail vehicle on the track from the known location of the beacon that the antenna on board the rail vehicle is passing in addition to transmitting information is known in the art. Location is usually effected by analyzing the power of the signal picked up by the antenna. The moment at which the signal picked up by the antenna is at a maximum coincides with the moment at which the antenna is located above the beacon.

However, this kind of location method provides only relatively inaccurate location of the vehicle, the signal picked up by the antenna being at a maximum over a relatively wide range to enable information to be transmitted. In the EUROBALISE system employing beacons approximately 50 cm long, the accuracy in locating the vehicle is of the order of ±20 cm for a vehicle speed less than 40 kph and of the order of ±1 m for a vehicle speed greater than 300 kph.

This is not accurate enough for automatic vehicle control systems, in particular automatic vehicle control systems for a metro, which require an accuracy generally better than ±5 cm for correctly positioning the metro relative to the platform in stations.

The object of the present invention is therefore to propose a system and a method for locating a rail vehicle precisely relative to a system of beacons, in particular EUROBALISE beacons, which is simple and economical to implement.

SUMMARY OF THE INVENTION

The invention provides a system for locating a rail vehicle at points along a rail track equipped with a system of beacons, the beacons being adapted to convey information to the vehicle by transmitting an electromagnetic signal, the vehicle including an antenna having a first receiver circuit for picking up electromagnetic signals transmitted by the beacon when the antenna passes it, the antenna including a second receiver circuit in the form of a figure-of-eight loop for accurately determining the moment at which the antenna is centered over the beacon.

The invention also provides a system for locating a vehicle having any of the following features:

- the first receiver circuit is in the form of a simple loop;
- the beacon is powered by radiation and includes an antenna circuit picking up energy radiated by a transmitter on board the rail vehicle and supplying the necessary energy to a transmitter circuit of the beacon;
- the beacon includes a transmitter circuit consisting of a loop and the external size of the figure-of-eight loop forming the second receiver circuit is substantially equal to the size of the loop of the transmitter circuit of the beacon;
- the second receiver circuit is centered on the first receiver circuit so that the crossover point of the figure-of-eight loop forming the second receiver circuit is substantially at the center of the loop forming the first receiver circuit;
- the system of beacons conforms to the EUROBALISE standard.

The invention also provides a method of locating a vehicle equipped with a system having any of the features defined above in which the phase shift of the signal delivered by the second receiver circuit relative to the signal delivered by the first receiver circuit is detected in order to deduce therefrom the moment at which the antenna is centered over the beacon.

The invention also provides an antenna for picking up electromagnetic waves transmitted by a beacon, the antenna including a first receiver circuit in the form of a simple loop for receiving information communicated by the beacon and a second receiver circuit in the form of a figure-of-eight loop for determining the precise moment at which the antenna is centered over the beacon.

According to one feature of the antenna according to the invention, the antenna is on board a rail vehicle and cooperates with beacons conforming to the EUROBALISE standard.

Aims, aspects and advantages of the present invention will become clearer after reading the following description of one embodiment of the invention, which description is given by way of non-limiting example and with reference to the accompanying drawings.

DETAILED DESCRIPTION OF THE PREFERRED EMBODIMENT

To make the drawings easier to read, only items needed for understanding the invention are shown.

Figure 1:
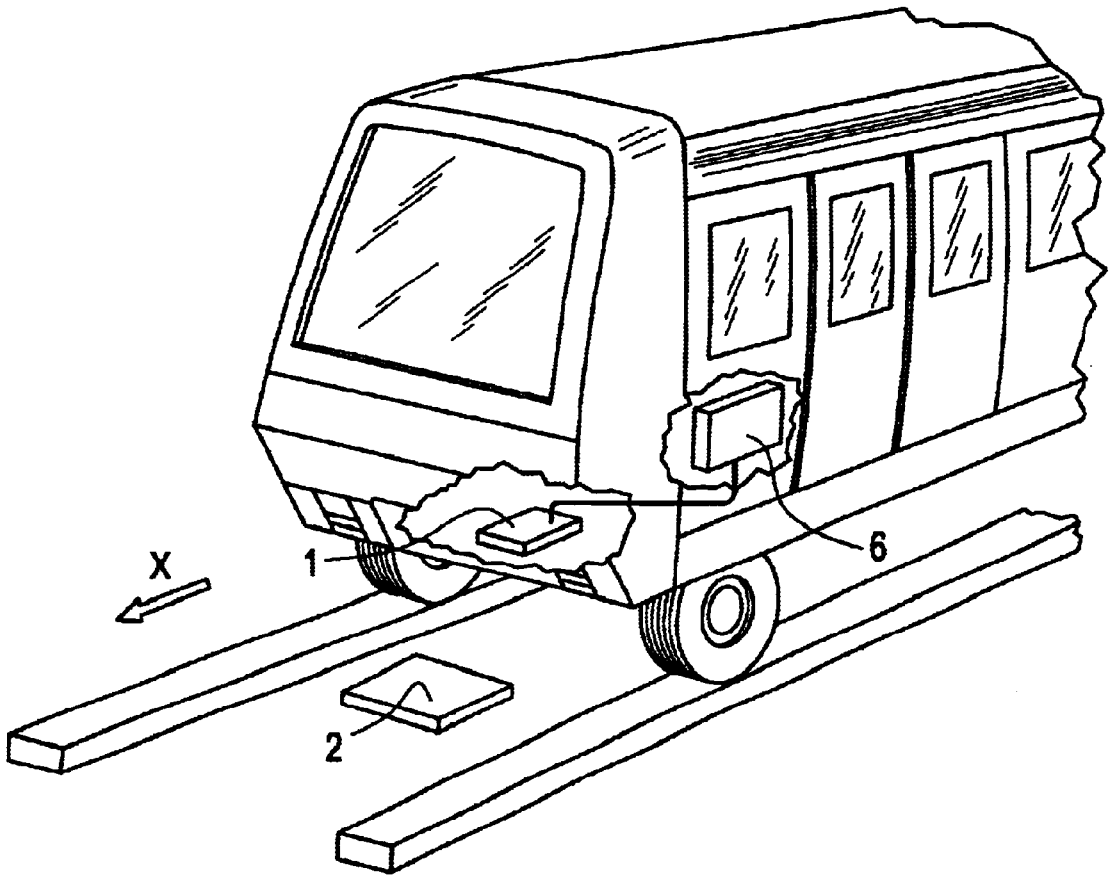
FIG. 1 is a general view of a system according to the invention for locating a rail vehicle relative to a beacon.

FIG. 1 shows a system for locating a rail vehicle on a rail track, the system including ground installations which mainly consist of beacons 2 of a type known in the art including control electronics and installed along the rail track at known locations.

The location system also includes equipment on board the rail vehicle which mainly consist of a receiver antenna and an evaluation unit 6. The evaluation unit 6 can be a computer. It is powered by its own converter and is connected to the antenna 1. The antenna 1 is located under the vehicle at a location such that the antenna 1 passes over the axis of the beacons 2 when the train travels along the rail track.

Figure 2:
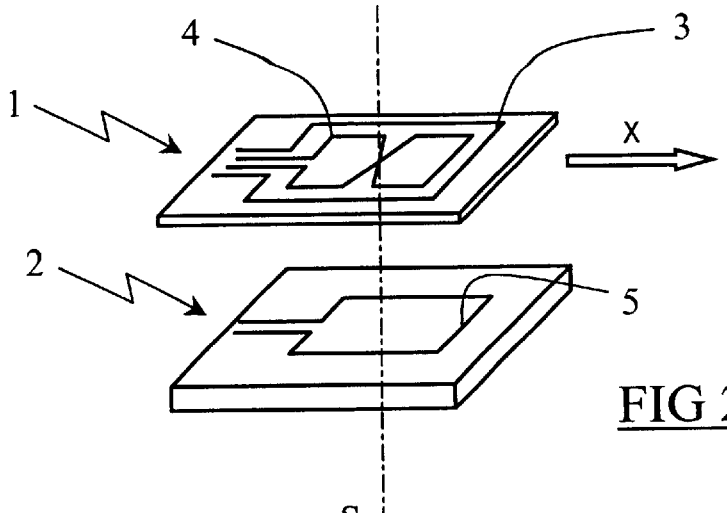
FIG. 2 is a diagrammatic representation of one particular embodiment of the antenna according to the invention, shown facing a beacon.

As shown in FIG. 2, the beacons 2 include a transmitter circuit provided with a transmitter loop adapted to transmit electromagnetic waves representative of information to be conveyed to the vehicle. The beacons 2 are preferably powered by radiation from an onboard transmitter via the antenna 1 of the rail vehicle, the latter providing the energy necessary for operation of the beacon 2 that the rail vehicle is passing. This way of electrically powering the beacon 2 involves integrating into the beacon an antenna circuit provided with a receiver coil connected in series with the primary of an isolating transformer whose secondary is connected to the transmitter circuit of the beacon, for example. The beacons 2 advantageously conform to the EUROBALISE European standard, i.e. they communicate by magnetic coupling with the antenna 1 of the vehicle in the frequency band from 3.9 to 4.5 MHz. These beacons have the advantage of being compact, with a length of approximately 50 cm, and light in weight, with a weight of approximately 5 kg.

The antenna 1 of the vehicle includes a first receiver circuit 3 which is a simple loop. This is known in the art. The first receiver circuit 3 is adapted to pick up the signal transmitted by the beacon 2 and is connected to the evaluation unit 6 of the vehicle which analyzes information transmitted by the beacon 2 that the antenna 1 is passing.

In accordance with the invention, the antenna 1 also includes a second receiver circuit 4 which consists of a figure-of-eight loop substantially concentric with the simple loop of the first receiver circuit 3. The second receiver circuit 4 is also connected to the evaluation unit 6 of the vehicle. The size of the figure-of-eight loop is preferably similar to the size of the transmitter loop of the beacon 2 in order to optimize the accuracy with which the antenna 1 is located.

The operation of the system and the method of locating the rail vehicle relative to a beacon are described next.

When the vehicle approaches a beacon 2 and the transmitter of the antenna 1 of the vehicle is in the coverage area of the beacon 2, i.e. when the energy level picked up by the beacon on the ground is sufficient for it to operate, the beacon 2 transmits an electromagnetic signal representative of the information to be conveyed.

Figure 3:
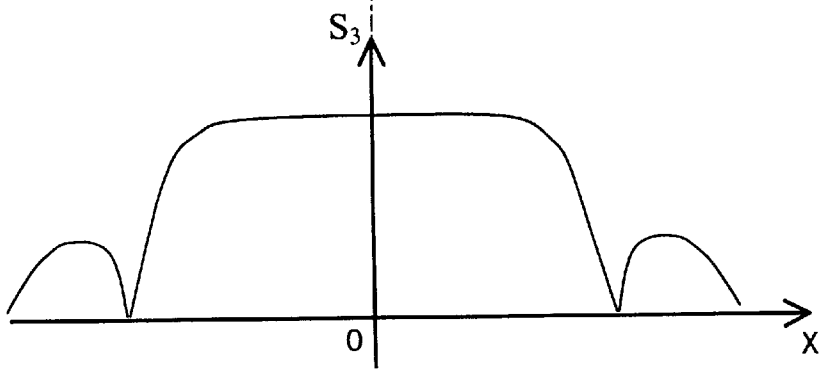
FIG. 3 is a graph representing the power of the signal picked up by a first receiver circuit equipping the antenna from FIG. 2 as a function of the position of the antenna relative to the beacon.

That signal is picked up by the antenna 1 of the vehicle and in particular by the loop forming the first receiver circuit 3. FIG. 3 shows the power of the signal picked up by the first receiver circuit 3 as a function of the movement of the antenna 1 carried by the vehicle along the axis X. As shown in FIG. 3, the first receiver circuit 3 of the antenna 1 delivers a signal $S_3$ which is at a maximum over a relatively broad range centered on the area of contact of the beacon 2, so that the signal picked up in this way can be used by the evaluation unit 6 to analyze the information transmitted by the beacon 2. The amplitude of the signal varies at the ends of the coverage area of the beacon and cancels out at the start and at the end of the area, although there are secondary lobes on either side of the coverage area.

Figure 4:
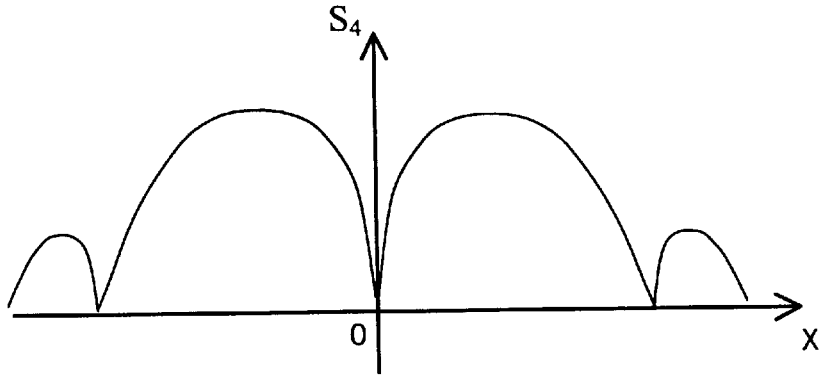
FIG. 4 is a graph representing the power of the signal picked up by a second receiver circuit equipping the antenna from FIG. 2 as a function of the position of the antenna relative to the beacon.
Figure 5:
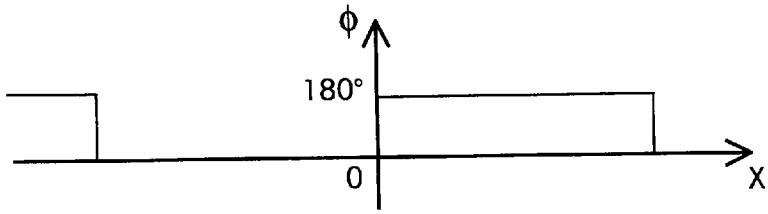
FIG. 5 shows the phase difference between the signals picked up by the first and second receiver circuits according to the position of the antenna relative to the beacon.

At the same time, the signal transmitted by the beacon 2 is picked up by the second receiver circuit 4 of the antenna 1. FIG. 4 shows the power of the signal picked up by the second receiver circuit 4 as a function of the movement of the antenna 1 along the axis X. As shown in FIG. 4, the second receiver circuit 4 delivers a signal $S_4$ whose amplitude varies at the beginning and at the end of the coverage area of the beacon 2 and which is zero at the center of the coverage area, i.e. when the crossover point of the figure-of-eight loop is centered in the transmitter loop of the beacon 2. The signal $S_4$ also has secondary lobes on either side of the coverage area. Also, as shown in FIG. 5, which shows the phase difference between the signal delivered by the secondary receiver circuit 4 and the signal delivered by the first receiver circuit 3, a 180° phase shift occurs between the signal from the first receiver circuit 3 and the signal from the second receiver circuit 4 when the center of the figure-of-eight loop of the second receiver circuit 4 passes over the center of the beacon 2.

Thus in the location method according to the invention the evaluation unit 6 detects the 180° phase shift between the signals delivered by the second receiver circuit 4 and by the first receiver circuit 3 and deduce therefrom the moment at which the antenna 1 is centered over the beacon 2. This location method identifies the moment at which the antenna 1 is centered over the beacon 2 with an accuracy of better than ±5 cm and therefore locates the vehicle on the rail track with an accuracy of the same order.

To make the location method more secure, the location of the antenna 1 relative to the beacon 2 is advantageously validated only if the signal transmitted by the beacon 2 contains an information message. To validate the location the evaluation unit 6 verifies that the detected phase shift is accompanied by the reception of a clear message by the first receiver circuit 3. What is more, the location method can be made even more secure by employing a voltage threshold to filter all spurious phase shifts that may occur at the secondary lobes existing at the ends of the coverage area of the beacon.

The above kind of system associated with the above kind of method therefore has the advantage of locating the rail vehicle on the rail track anew on passing each beacon, with an accuracy of better than ±5 cm, and using a standard EUROBALISE beacon widely used on rail networks.

It is therefore possible, by equipping a rail vehicle with the antenna according to the invention, to locate the vehicle with sufficient accuracy for operation of automatic train control systems.

The location system and method according to the invention therefore provide very good accuracy at each of the points at which the position of the vehicle on the rail track is determined simply by equipping the rail vehicle with an antenna in accordance with the invention, which is highly economical.

Of course, the invention is in no way limited to the embodiment described and shown, which is provided merely by way of example. The embodiment described and shown can be modified without departing from the scope of protection of the invention, in particular from the point of view of the composition of its various components or by substituting technical equivalents.

What is claimed is:

1. A system for locating a rail vehicle at points along a rail track equipped with a system of beacons, said beacons being adapted to convey information to the vehicle by transmitting an electromagnetic signal, said vehicle including an antenna having a first receiver circuit for picking up electromagnetic signals transmitted by a particular beacon when said antenna passes it, said particular beacon including a transmitter circuit having a loop, said antenna including a second receiver circuit in the form of a figure-of-eight loop for accurately determining the moment at which said antenna is centered over said particular beacon, the external size of said figure-of-eight loop forming said second receiver circuit being substantially equal to the size of said loop of said transmitter circuit of said beacon.

2. The system claimed in claim 1 wherein said first receiver circuit is in the form of a simple loop.

3. The system claimed in claim 1 wherein said particular beacon is powered by radiation and includes an antenna circuit picking up energy radiated by a transmitter on board said rail vehicle and supplying the necessary energy to said transmitter circuit of said particular beaacon.

4. The system claimed in claim 1 wherein said second receiver circuit is centered on said first receiver circuit so that the crossover point of said figure-of-eight loop forming said second receiver circuit is substantially at the center of said loop forming said first receiver circuit.

5. The system claimed in claim 1 wherein said system of beacons conforms to the EUROBALISE standard.

6. A method of locating a vehicle equipped with a system for locating a rail vehicle at points along a rail track equipped with a system of beacons, said beacons being adapted to convey information to the vehicle by transmitting an electromagnetic signal, said vehicle including an antenna having a first receiver circuit for picking up electromagnetic signals transmitted by a particular beacon when said antenna passes it, said antenna including a second receiver circuit in the form of a figure-of-eight loop for accurately determining the moment at which said antenna is centered over said particular beacon, in which method the phase shift of the signal delivered by said second receiver circuit relative to the signal delivered by said first receiver circuit is detected in order to deduce therefrom the moment at which said antenna is centered over said particular beacon, a threshold being employed to filter all spurious phase shifts that may occur at the secondary lobes existing at the ends of the coverage area of said particular beacon.

7. The method claimed in claim 6 wherein said first receiver circuit is in the form of a simple loop.

8. The method claimed in claim 6 wherein said particular beacon is powered by radiation and includes an antenna circuit picking up energy radiated by a transmitter on board said rail vehicle and supplying the necessary energy to a transmitter circuit of said particular beacon.

9. The method claimed in claim 6 wherein said second receiver circuit is centered on said first receiver circuit so that the crossover point of said figure-of-eight loop forming said second receiver circuit is substantially at the center of said loop forming said first receiver circuit.

10. The method claimed in claim 6 wherein said system of beacons conforms to the EUROBALISE standard.

11. An antenna for picking up electromagnetic waves transmitted by a beacon including a transmitter circuit having a loop, said antenna including a first receiver circuit in the form of a simple loop for receiving information communicated by said beacon and a second receiver circuit in the form of a figure-of-eight loop for determining the precise moment at which said antenna is centered over said beacon, the external size of said figure-of-eight loop forming said second receiver circuit being substantially equal to the size of said loop of said transmitter circuit of said beacon.

12. The antenna claimed in claim 11 when it is on board a rail vehicle and cooperates with beacons conforming to the EUROBALISE standard.

13. The system claimed in claim 1, wherein an evaluation unit detects a phase shift of a signal delivered by said second receiver circuit relative to a signal delivered by said first receiver circuit in order to deduce therefrom the moment at which said antenna is centered over said particular beacon, a threshold being employed to filter all spurious phase shifts that may occur at secondary lobes existing at the ends of a coverage area of said particular beacon.

* * * * *